US005733473A

United States Patent [19]

Johnston et al.

[11] Patent Number: 5,733,473

[45] Date of Patent: Mar. 31, 1998

[54] LIQUID DETERGENT COMPOSITION CONTAINING LIPASE AND PROTEASE

[75] Inventors: James Pyott Johnston, Overijse, Belgium; Pierre Marie Alain Lenoir, Zürich, Switzerland; Christiaan Arthur J. K. Thoen, Hassdonk, Belgium

[73] Assignee: The Procter & Gamble Company, Cincinnati, Ohio

[21] Appl. No.: 322,965

[22] Filed: Oct. 13, 1994

Related U.S. Application Data

[63] Continuation of Ser. No. 50,296, filed as PCT/US91/08041, Nov. 4, 1991.

[30] Foreign Application Priority Data

Nov. 14, 1990 [BE] Belgium ..... 90870212.9
Jan. 25, 1991 [BE] Belgium ..... 91200149.2

[51] Int. Cl.[6] ..... C11D 3/386

[52] U.S. Cl. ..... 252/135; 252/174.12; 252/DIG. 12; 252/174.21; 252/549

[58] Field of Search ..... 252/135, 174.12, 252/DIG. 12, 174.21, 549; 435/264, 219, 223, 188

[56] References Cited

U.S. PATENT DOCUMENTS

| | | | |
|---|---|---|---|
| 4,760,025 | 7/1988 | Estell et al. | 435/222 |
| 4,810,414 | 3/1989 | Huge-Jensen et al. | 252/174.12 |
| 4,959,179 | 9/1990 | Aronson | 252/135 |
| 4,980,288 | 12/1990 | Bryan et al. | 435/222 |
| 5,030,378 | 7/1991 | Venegas et al. | 252/174.12 |
| 5,078,898 | 1/1992 | Jars | 252/174.12 |
| 5,112,518 | 5/1992 | Klugkist et al. | 252/174.12 |
| 5,208,158 | 5/1993 | Bech et al. | 435/219 |
| 5,292,448 | 3/1994 | Klugkist | 252/174.12 |

FOREIGN PATENT DOCUMENTS

| | | | |
|---|---|---|---|
| 0 328 229 | 2/1989 | European Pat. Off. | C12N 9/50 |
| 0511456 | 11/1992 | European Pat. Off. . | |
| 2271120 | 4/1994 | United Kingdom . | |
| WO 89/04361 | 5/1989 | WIPO | C11D 3/386 |
| 8906279 | 7/1989 | WIPO . | |
| 9116423 | 10/1991 | WIPO . | |
| 9211348 | 9/1992 | WIPO . | |
| 9429428 | 12/1994 | WIPO . | |

*Primary Examiner*—Paul Lieberman
*Assistant Examiner*—Kery A. Fries
*Attorney, Agent, or Firm*—George W. Allen

[57] ABSTRACT

Liquid detergent compositions are disclosed which contain conventional detergency ingredients and an enzyme system, wherein the enzyme system comprises a mixture of a lipase, or mixtures thereof, and a modified bacterial serine protease, or mixtures of said proteases.

6 Claims, No Drawings

LIQUID DETERGENT COMPOSITION CONTAINING LIPASE AND PROTEASE

CROSS REFERENCE TO RELATED APPLICATION

This is a continuation of application Ser. No. 08/050,296, filed as PCT/US91/08041, Nov. 4, 1991.

TECHNICAL FIELD

The present invention relates to liquid detergent compositions which contain an enzyme system. The enzyme system is a combination of a modified protease and a lipase.

BACKGROUND

It is well known in the art that detergent compositions may advantageously comprise enzyme systems. Such enzyme systems include cellulase, protease, lipase and amylases. The present invention is specifically aiming at providing liquid detergent compositions in which the enzyme system comprises a mixture of protease and lipase.

Formulating such a combination in a granular detergent raises no specific issue, since both enzymes can be physically separated. On the contrary, formulating such a combination in a liquid detergent raises a specific technical issue in that the protease is likely to take as a substrate any protein present in the detergent composition.

Specifically, it has been observed that lipases which may also be present in the detergent composition are particularly subject to such proteolytic degradation; as a consequence, the residual activity of the lipase in the detergent composition will rapidly diminish with the storage time of the detergent composition, so that it was up to now impossible to formulate liquid detergent compositions comprising at the same time a lipase and a protease, said detergent compositions being sufficiently stable for a commercial exploitation.

It is thus an object of the present invention to provide a liquid detergent composition comprising an enzyme system comprising a lipase and a protease, wherein said enzyme system is stable; by stable, it is meant that the proteolytic degradation of the lipase is substantially reduced.

It has now been found that this object can be met by using any lipase, or mixtures thereof, together with a bacterial serine protease wherein the methionine adjacent to the serine of the active site has been replaced by another amino acid, or mixtures of such proteases. Indeed, it has been discovered that this specific combination would provide an enzyme system comprising a protease and a lipase, which would be stable in a liquid detergent composition.

This solution has the advantage of being simple because it only requires ingredients which are commercially available; indeed, several modified bacterial serine proteases suitable for the purpose of this invention are commercially available, as well as several lipases suitable for use in a detergent composition. Furthermore, the detergent compositions according to the invention require no addition of specific lipase stabilizers, and are therefore particularly attractive in terms of product cost and environmental compatibility.

Modified bacterial serine proteases including proteases suitable for use in the compositions according to the invention are disclosed for instance in EP-A-0 328 229 as well as their use in detergent compositions. This patent application describes among others a modified bacterial serine protease which is commercially available from GIST-BROCADES under the name MAXAPEM 15®

Biotechnology Newswatch, published March 1988, page 6, and EP-A-0 258 268 describe a lipase enzyme which is commercially available from NOVO NORDISK A/S under the trade name LIPOLASE®. This European Patent application mentions that LIPOLASE® can be combined with proteases to form a granular enzymatic detergent additive.

EP-A-0 381 262 describes detergent compositions comprising a protease and a lipase, preferably LIPOLASE®, together with a stabilizing system. The proteases disclosed in this reference include bacterial proteases.

SUMMARY OF THE INVENTION

Accordingly, the present invention is a liquid detergent composition comprising an enzyme system, characterized in that the enzyme system comprises a modified bacterial serine protease or mixtures thereof, and a lipase or mixtures thereof. The bacterial serine protease is modified in that the methionine adjacent to the serine of the active site is substituted by another amino acid.

DETAILED DESCRIPTION OF THE INVENTION

The enzyme system according to the present invention comprises a lipase and a protease. Any lipase suitable for use in a detergent composition can be used in the compositions according to the invention, as described for instance in EP 0 381 262 or EP 271 152. The preferred lipase to be used in the compositions according to the present invention is a lipase derived from *Humicola lanuginosa*, as described in EP-A-0 258 068 to NOVO INDUSTRI A/S. This patent application describes how to obtain said specific lipase, but said specific lipase is also commercially available from NOVO NORDISK A/S under the trade name LIPOLASE®. Other commercially available lipases suitable for use herein are Amono-P Lipase®, Amono-B Lipase®, Amono CES Lipase®, Amono AKG Lipase®, all from Amono Pharmaceuticals Japan; Toyo Jozo Co Japan and US biochemical Corp. USA as well as Diosynth Co, NL also commercialize suitable lipases for use in the compositions according to the present invention.

The compositions according to the present invention typically comprise from 0.1 to 10000 Lipolytic Units per gram of finished product, preferably from 10 to 2500 Lipolytic Units per gram of finished product. Lipolytic units are defined for instance in EP 0 258 268, page 5 line 38.

The proteases to be used according to the present invention are modified bacterial serine proteases. All native bacterial serine proteases are characterized in that the active site invariably comprises a triade of amino acids which are serine, histidine and aspartic acid. These amino acids are positioned in the native form of the enzyme in such a way that they catalyse the cleavage of internal peptide bonds of proteins. Another common point between these bacterial serine proteases is that there always is a methionine adjacent to the serine of the active site, in the native sequence. The bacterial serine proteases suitable for use according to the present invention are those wherein the methionine adjacent to the serine of the active site has been substituted by another amino acid. The serine of the active site can also be defined as the serine which is homologuous to the serine in position 221 in the amino acid sequence of the bacterial subtilisin protease produced by *Bacillus Subtills*; said sequence is listed herein after in SEQ ID NO: 1 and SEQ ID NO: 2.

In the sequence of this bacterial subtilisin protease produced by *Bacillus Subtilis*, the methionine is immediately after the serine in position 221 and therefore it is the methionine in position 222 which needs to be substituted by another amino acid. It is possible that, in the sequence of other bacterial serine proteases, this methionine would not be immediately following the serine of the active site; in such a case, it is the methionine homologuous to the methionine in position 222 in the sequence of this bacterial subtilisin protease produced by *Bacillus Subtilis* which needs to be substituted by another amino acid.

It is to be understood that the present invention does not reside in these modified proteases per se, rather in the particular application of these modified proteases to liquid detergent compositions also comprising a lipase; it is therefore not the aim of the present description to specify how these modified proteases can be obtained; This modification can be done by site-directed mutagenesis or any other genetic engineering technique well known in the art for this purpose; for instance, EP-A-0 328 229, to GIST-BROCADES N.V. describes how to obtain such proteases. Another suitable method is described in EP 130 756, which also describes a modified bacterial serine protease suitable for use in the compositions according to the invention.

Furthermore, some modified bacterial serine proteases suitable for use in the compositions according to the invention are commercially available, such as DURAZYM® from NOVO, which is the methionine modified version of SAVINASE®; another example of available modified protease is MAXAPEM 15 from GIST-BROCADES, which is the modified version of MAXACAL® wherein the methionine in position 216 has been substituted. Also available are experimental samples of modified OPTICLEAN® and OPTIMASE®, from SOLVAY enzymes; both are modified in that the methionine in position 222 is substituted by a cysteine. Preferred modified bacterial serine protease according to the present invention are MAXAPEM 15® from GIST BROCADES and DURAZYM® from NOVO.

The compositions according to the present invention typically will contain from 0.005 to 10 mg of active protease per gram of finished product, preferably from 0.01 to 5.0 mg of active protease per gram of finished product. Mixtures of the modified bacterial serine protease described herein above are also suitable for use in the compositions according to the invention.

The rest of the liquid detergent composition according to the present invention is made of conventional detergency ingredients, i.e. water, surfactants, builders and others. The following description of these ingredients is for the sake of completeness of the description and is not to be construed as limiting the compositions of the present invention to those conventional ingredients described.

The liquid detergent compositions herein comprises from 5% to 60% by weight of the total liquid detergent composition, preferably from 10% by weight to 40% by weight of an organic surface-active agent selected from nonionic, anionic, cationic and zwitterionic surface-active agents and mixtures thereof.

Suitable anionic surface-active salts are selected from the group of sulfonates and sulfates. The like anionic surfactants are well-known in the detergent arts and have found wide application in commercial detergents. Preferred anionic water-soluble sulfonate or sulfate salts have in their molecular structure an alkyl radical containing from about 8 to about 22 carbon atoms.

Examples of such preferred anionic surfactant salts are the reaction products obtained by sulfating $C_8$-$C_{18}$ fatty alcohols derived from e.g. tallow oil, palm oil, palm kernel oil and coconut oil: alkylbenzene sulfonates wherein the alkyl group contains from about 9 to about 15 carbon atoms; sodium alkylglyceryl ether sulfonates; ether sulfates of fatty alcohols derived from tallow and coconut oils: coconut fatty acid monoglyceride sulfates and sulfonates; and water-soluble salts of paraffin sulfonates having from about 8 to about 22 carbon atoms in the alkyl chain. Sulfonated olefin surfactants as more fully described in e.g. U.S. Pat. No. 3,332,880 can also be used. The neutralizing cation for the anionic synthetic sulfonates and/or sulfates is represented by conventional cations which are widely used in detergent technology such as sodium, potassium or alkanolammonium.

A suitable anionic synthetic surfactant component herein is represented by the water-soluble salts of an alkylbenzene sulfonic acid, preferably sodium alkylbenzene sulfonates, preferably sodium alkylbenzene sulfonates having from about 10 to 13 carbon atoms in the alkyl group. Another preferred anionic surfactant component herein is sodium alkyl sulfates having from about 10 to 15 carbon atoms in the alkyl group.

The nonionic surfactants suitable for use herein include those produced by condensing ethylene oxide with a hydrocarbon having a reactive hydrogen atom, e.g., a hydroxyl, carboxyl, or amido group, in the presence of an acidic or basic catalyst, and include compounds having the general formula $RA(CH_2CH_2O)_nH$ wherein R represents the hydrophobic moiety, A represents the group carrying the reactive hydrogen atom and n represents the average number of ethylene oxide moieties. R typically contains from about 8 to 22 carbon atoms. They can also be formed by the condensation of propylene oxide with a lower molecular weight compound. n usually varies from about 2 to about 24.

A preferred class of nonionic ethoxylates is represented by the condensation product of a fatty alcohol having from 12 to 15 carbon atoms and from about 4 to 10 moles of ethylene oxide per mole or fatty alcohol. Suitable species of this class of ethoxylates include: The condensation product of $C_{12}$-$C_{15}$ oxo-alcohols and 3 to 9 moles of ethylene oxide per mole of alcohol; the condensation product or narrow cut $C_{14}$-$C_{15}$ oxo-alcohols and 3 to 9 moles of ethylene oxide per mole of fatty(oxo)alcohol; the condensation product of a narrow cut $C_{12}$-$C_{13}$ fatty(oxo)alcohol and 6.5 moles of ethylene oxide per mole of fatty alcohol; and the condensation products of a $C_{10}$-$C_{14}$ coconut fatty alcohol with a degree of ethoxylation (moles EO/mole fatty alcohol) in the range from 4 to 8. The fatty oxo alcohols while mainly linear can have, depending upon the processing conditions and raw material olefins, a certain degree of branching, particularly short chain such as methyl branching. A degree of branching in the range from 15% to 50% (weight %) is frequently found in commercial oxo alcohols.

Suitable cationic surfactants include quaternary ammonium compounds of the formula $R_1R_2R_3R_4N^+$ where $R_1$, $R_2$ and $R_3$ are methyl groups, and $R_4$ is a $C_{12-15}$ alkyl group, or where $R_1$ is an ethyl or hydroxy ethyl group, $R_2$ and $R_3$ are methyl groups and $R_4$ is a $C_{12-15}$ alkyl group.

Zwitterionic surfactants include derivatives of aliphatic quaternary ammonium, phosphonium, and sulfonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulfonates and sulfates disclosed in U.S. Pat. Nos. 3,925,262, Laughlin et al., issued Dec. 9, 1975 and 3,929,678, Laughlin et al., issued Dec. 30, 1975.

Semi-polar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures.

Also suitable are Poly hydroxy fatty acid amide surfactants of the formula $R^2$-C-N-Z, wherein $R^1$ is H, $OR^1$ $C_{1-4}$ hydrocarbyl, 2-hydroxy ethyl, 2-hydroxy propyl or a mixture thereof, $R_2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R_1$ is methyl, $R_2$ is a straight $C_{11-15}$ alkyl or alkenyl chain or mixtures thereof, and Z is derived from a reducing sugar such as glucose, fructose, maltose, lactose, in a reductive amination reaction.

The compositions according to the present invention may further comprise a builder system. Any conventional builder system is suitable, but preferred is a mixture of citric acid and a substituted succinic acid.

The citric acid builder employed in the practice of this invention will be present in the finished product in the form of any water-soluble salt of citric acid. Such salts include, for example, sodium, potassium, Ammonium or alkanolammonium salts. In practice it is convenient to use a citric acid monohydrate slurry as a starting material, which will be neutralized in situ, so as to form the above mentioned salts.

The substituted succinic acid builders herein are of the general formula R—CH(COOH)$CH_2$(COOH), i.e., derivatives of succinic acid, wherein R is $C_{10}$-$C_{16}$ alkyl or alkenyl, preferably $C_{12}$-$C_{14}$ alkenyl.

These substituted succinic acid builders are preferably in the finished product in the form of their water-soluble salts, including the sodium, potassium, ammonium and alkanolammonium salts (e.g., mono-, di-, or tri-ethanolammonium).

As raw materials, it is preferred to use these succinic acid derivatives in their diacid or anhydride form. The diacid will be neutralized in situ, while the anhydride will undergo a hydrolysis/neutralization process.

Specific examples of substituted succinic acid builders include: lauryl succinic acid, myristyl succinic acid, palmityl succinic acid, 2-dodecenyl succinic acid (preferred), 2-tetradecenyl succinic acid, and the like.

A preferred builder system comprises from 4% to 12% by weight of the total composition of the above substituted succinic acid builders, and from 4% to 12% by weight of the total composition of citric acid. As an alternative builder, the compositions according to the invention may also contain a fatty acid. Preferred are oleic and palmitoleic acid.

It is well known from the man skilled in the art that the pH of the composition may significantly affect the enzyme system's performance. Accordingly, the compositions according to the invention preferably have a pH adjusted in the range of from 6 to 10, preferably from 7.5 to 8.0.

The compositions according to the invention may also comprise an enzyme stabilizing system. Indeed, the present invention provides a system wherein the protease does not significantly attack the native lipase, but the enzyme system or components thereof may still be subject to unstability problem due to the other detergency ingredients. Therefore, stabilizing agents may be needed, which are conventional and well known in the art. A preferred enzyme stabilizing system is selected from boric acid, 1,2-propanediol, carboxylic acids, and mixtures thereof. These enzyme stabilizing systems are typically present in amounts of from 0.01% to 5% by weight of the total composition.

The compositions of the invention may also comprise other enzymes such as cellulases or amylases. Amylases, particularly, seem to be stable in the presence of protease, and the compositions of the invention therefore preferably comprise an amylase.

The compositions herein can contain a series of further optional ingredients. Examples of the like additives include: suds regulants, opacifiers, agents to improve the machine compatibility in relation to enamel-coated surfaces, bactericides, dyes, perfumes, bleaches including perborate and percarbonate, brighteners, soil release agents, softening agents and the like.

The liquid compositions herein can contain further additives, typically at levels of from 0.05 to 5%. These additives include polyaminocarboxylates such as ethylenediaminotetracetic acid, diethylenetriaminopentacetic acid, ethylenediamino disuccinic acid or water-soluble alkali metals thereof. Other additives include organo-phosphonic acids; particularly preferred are ethylenediamino tetramethylenephosphonic acid, hexamethylenediamino tetramethylenephosphonic acid, diethylenetrtamino pentamethylenephosphonic acid and aminotrimethylenephosphonic acid.

EXAMPLES

The following compositions according to the invention are made by mixing the listed ingredients in the listed proportions.

| | 1 | 2 | 3 | 4 | 5 |
|---|---|---|---|---|---|
| Linear alkyl benzene sulfonate | 12 | 7 | 6 | 7 | 8 |
| Sodium $C_{12-15}$ alkyl sulfate | 2 | 2 | 3 | 3 | 2 |
| $C_{14-15}$ alkyl 2.5 times ethoxylated sulfate | 0 | 0 | 2 | 2 | 0 |
| $C_{12}$ glucose amide | 0 | 0 | 6 | 6 | 0 |
| $C_{12-15}$ alcohol 7 times ethoxylated | 8 | 0 | 0 | 0 | 0 |
| $C_{12-15}$ alcohol 5 times ethoxylated | 0 | 8 | 0 | 0 | 8 |
| Oleic Acid | 2 | 0 | 0 | 0 | 0 |
| Citric Acid | 3 | 9 | 9 | 13 | 15 |
| $C_{12-14}$ alkenyl substituted succinic acid | 10 | 5 | 5 | 7 | 6 |
| Ethanol | 4 | 4 | 3 | 4 | 5 |
| 1,2-propanediol | 2 | 3 | 3 | 1 | 2 |
| NaOH | 6 | 8 | 8 | 11 | 11 |
| diethylene triamine penta(methylene phosphonic acid) | 0.5 | 0.7 | 0.7 | 1 | 1 |
| Amylase (143 KNU/g) | 0.1 | 0.1 | 0.05 | 0.2 | 0.1 |
| LipolaseR(100 KLU/g commercial solution) | 0.4 | 0.2 | 0.3 | 0.3 | 0.3 |
| PEM15R (50 mg/g Commercial solution) | 0.3 | 0 | 0 | 0 | 0.4 |
| Durazym$^R$ (39 mg/g Commercial solution) | 0 | 0.2 | 0 | 0 | 0 |
| Opticlean M222C$^R$ (experimental sample) | 0 | 0.1 | 0 | 0.4 | 0 |
| Optimase M222C$^R$ (experimetnal sample) | 0 | 0 | 0.3 | 0 | 0 |
| CaC12 | 0.01 | 0 | 0.01 | 0.01 | 0.02 |
| Na metaborate | 2.2 | 2 | 2 | 4 | 3 |
| TEA | 0 | 0 | 0 | 0 | 0 |
| Sodium formate | 0 | 0 | 0 | 0 | 0 |
| Fatty Acids | 0 | 0 | 0 | 0 | 0 |
| Water and Minors | | Balance to 100% | | | |

EXAMPLES

The following compositions according to the invention are made by mixing the listed ingredients in the listed proportions

| | 6 | 7 | 8 | 9 | 10 |
|---|---|---|---|---|---|
| Linear alkyl benzene sulfonate | 5 | 7 | 9 | 8 | 10 |
| Sodium $C_{12-15}$ alkyl sulfate | 5 | 2 | 1.75 | 0 | 3 |
| $C_{14-15}$ alkyl 2.5 times ethoxylated sulfate | 2 | 0 | 2 | 0 | 0 |
| $C_{12}$ glucose amide | 6 | 0 | 7 | 0 | 0 |
| $C_{12-15}$ alcohol 7 times ethoxylated | 0 | 0 | 0.5 | 0 | 11.6 |
| $C_{12-15}$ alcohol 5 times ethoxylated | 0 | 8 | 0 | 8 | |
| Oleic Acid | 0 | 0 | 0 | 3.5 | 2.5 |
| Citric Acid | 10 | 9 | 9.5 | 4 | 1 |
| $C_{12-14}$ alkenyl substituted succinic acid | 11 | 0 | 11.5 | 0 | 0 |
| STPP | 0 | 20 | 0 | 0 | 0 |
| Zeolite | 0 | 0 | 0 | 26 | 0 |
| Ethanol | 6 | 4 | 4 | 3 | 6 |
| 1,2-propanediol | 3 | 2 | 2 | 2 | 1.5 |
| NaOH | 9 | 9 | 9.8 | 9 | 3.5 |
| diethylene triamine penta(methylene phosphonic acid) | 1.0 | 1.0 | 1.0 | 0.5 | 0.8 |
| Amylase(143KNU/g) | 0.2 | 0.1 | 0.2 | 0.05 | 1 |
| Lipolase ® (100KLU/g commercial solution) | 0.5 | 0.5 | 0.3 | 0.2 | 0.3 |
| PEM15R(50 mg/g Commercial solution) | 0.4 | 0 | 0 | 0 | 0.2 |
| Durazym ® (39 mg/g Commercial solution) | 0 | 0 | 0.5 | 0 | 0.2 |
| Opticlean M222C ® (experimental sample) | 0 | 0 | 0 | 0.3 | 0 |
| Optimase M222C ® (experimental sample) | 0 | 0.5 | 0 | 0 | 0 |
| CaCl2 | 0.01 | 0.01 | 0.02 | 0.02 | 0.01 |
| Na metaborate | 4 | 2 | 4 | 3 | 0 |
| TEA | 0 | 0 | 0 | 0 | 6 |
| Sodium formate | 0 | 0 | 0 | 0 | 1 |
| Fatty Acids | 0 | 0 | 0 | 0 | 12 |
| Water and Minors | Balance to 100% | | | | |

EXAMPLES

The following compositions according to the invention are made by mixing the listed ingredients in the listed proportions

| | 11 | 12 | 13 | 14 | 15 |
|---|---|---|---|---|---|
| Linear alkyl benzene sulfonate | 5 | 7 | 9 | 8 | 10 |
| Sodium $C_{12-15}$ alkyl sulfate | 5 | 2 | 1.75 | 0 | 3 |
| $C_{14-15}$ alkyl 2.5 times ethoxylated sulfate | 2 | 0 | 2 | 0 | 0 |
| $C_{12}$ glucose amide | 6 | 0 | 7 | 0 | 0 |
| $C_{12-15}$ alcohol 7 times ethoxylated | 0 | 0 | 0.5 | 0 | 11.6 |
| $C_{12-15}$ alcohol 5 times ethoxylated | 0 | 8 | 0 | 8 | |
| Oleic Acid | 0 | 0 | 0 | 3.5 | 2.5 |
| Citric Acid | 10 | 9 | 9.5 | 4 | 1 |
| $C_{12-14}$ alkenyl substituted succinic acid | 11 | 0 | 11.5 | 0 | 0 |
| Tartrate monosuccinate | 0 | 15 | 0 | 17 | 20 |
| Diethoxylated poly (1,2 propylene terephtalate) | 1.0 | 0.5 | 0.7 | 0 | 0.5 |
| Ethanol | 6 | 4 | 4 | 3 | 6 |
| 1,2-propanediol | 3 | 2 | 2 | 2 | 1.5 |
| NaOH | 9 | 9 | 9.8 | 9 | 3.5 |
| diethylene triamine penta(methylene phosphonic acid) | 1.0 | 1.0 | 1.0 | 0.5 | 0.8 |
| Amylase(143KNU/g) | 0.2 | 0.1 | 0.2 | 0.05 | 1 |
| Lipolase ® (100KLU/g commercial solution) | 0.5 | 0.5 | 0.3 | 0.2 | 0.3 |
| PEM15 ® (50 mg/g Commercial solution) | 0.4 | 0 | 0 | 0 | 0.2 |
| Durazym ® (39 mg/g Commercial solution) | 0 | 0 | 0.5 | 0 | 0.2 |
| Opticlean M222C ® (experimental sample) | 0 | 0 | 0 | 0.3 | 0 |
| Optimase M222C ® (experimental sample) | 0 | 0.5 | 0 | 0 | 0 |
| CaCl2 | 0.01 | 0.01 | 0.02 | 0.02 | 0.01 |
| Na metaborate | 4 | 2 | 4 | 3 | 0 |
| TEA | 0 | 0 | 0 | 0 | 6 |
| Sodium formate | 0 | 0 | 0 | 0 | 1 |
| Fatty Acids | 0 | 0 | 0 | 0 | 12 |
| Water and Minors | Balance to 100% | | | | |

SEQUENCE LISTING ( 1 ) GENERAL INFORMATION:

( i i i ) NUMBER OF SEQUENCES: 2

( 2 ) INFORMATION FOR SEQ ID NO:1:

( i ) SEQUENCE CHARACTERISTICS:
( A ) LENGTH: 1500 base pairs
( B ) TYPE: nucleic acid
( C ) STRANDEDNESS: unknown
( D ) TOPOLOGY: unknown ( i i ) MOLECULE TYPE: cDNA ( i x ) FEATURE:
( A ) NAME/KEY: mat_peptide
( B ) LOCATION: 455..1282

( i x ) FEATURE:
( A ) NAME/KEY: CDS
( B ) LOCATION: 137..1282

( x i ) SEQUENCE DESCRIPTION: SEQ ID NO:1:

-continued

```
GATATACCTA AATAGAGATA AAATCATCTC AAAAAAATGG GTCTACTAAA ATATTATTCC      60

ATCTATTACA ATAAATTCAC AGAATAGTCT TTTAAGTAAG TCTACTCTGA ATTTTTTTAA     120

AAGGAGAGGG TAAAGA GTG AGA AGC AAA AAA TTG TGG ATC AGC TTG TTG          169
                  Val Arg Ser Lys Lys Leu Trp Ile Ser Leu Leu
                  -106-105                -100

TTT GCG TTA ACG TTA ATC TTT ACG ATG GCG TTC AGC AAC ATG TCT GCG        217
Phe Ala Leu Thr Leu Ile Phe Thr Met Ala Phe Ser Asn Met Ser Ala
-95                 -90                 -85                 -80

CAG GCT GCC GGA AAA AGC AGT ACA GAA AAG AAA TAC ATT GTC GGA TTT        265
Gln Ala Ala Gly Lys Ser Ser Thr Glu Lys Lys Tyr Ile Val Gly Phe
                -75                 -70                 -65

AAA CAG ACA ATG AGT GCC ATG AGT TCC GCC AAG AAA AAG GAT GTT ATT        313
Lys Gln Thr Met Ser Ala Met Ser Ser Ala Lys Lys Lys Asp Val Ile
            -60                 -55                 -50

TCT GAA AAA GGC GGA AAG GTT CAA AAG CAA TTT AAG TAT GTT AAC GCG        361
Ser Glu Lys Gly Gly Lys Val Gln Lys Gln Phe Lys Tyr Val Asn Ala
        -45                 -40                 -35

GCC GCA GCA ACA TTG GAT GAA AAA GCT GTA AAA GAA TTG AAA AAA GAT        409
Ala Ala Ala Thr Leu Asp Glu Lys Ala Val Lys Glu Leu Lys Lys Asp
    -30                 -25                 -20

CCG AGC GTT GCA TAT GTG GAA GAA GAT CAT ATT GCA CAT GAA TAT GCG        457
Pro Ser Val Ala Tyr Val Glu Glu Asp His Ile Ala His Glu Tyr Ala
-15                 -10                 -5                  1

CAA TCT GTT CCT TAT GGC ATT TCT CAA ATT AAA GCG CCG GCT CTT CAC        505
Gln Ser Val Pro Tyr Gly Ile Ser Gln Ile Lys Ala Pro Ala Leu His
            5                   10                  15

TCT CAA GGC TAC ACA GGC TCT AAC GTA AAA GTA GCT GTT ATC GAC AGC        553
Ser Gln Gly Tyr Thr Gly Ser Asn Val Lys Val Ala Val Ile Asp Ser
        20                  25                  30

GGA ATT GAC TCT TCT CAT CCT GAC TTA AAC GTC AGA GGC GGA GCA AGC        601
Gly Ile Asp Ser Ser His Pro Asp Leu Asn Val Arg Gly Gly Ala Ser
    35                  40                  45

TTC GTA CCT TCT GAA ACA AAC CCA TAC CAG GAC GGC AGT TCT CAC GGT        649
Phe Val Pro Ser Glu Thr Asn Pro Tyr Gln Asp Gly Ser Ser His Gly
50                  55                  60                  65

ACG CAT GTA GCC GGT ACG ATT GCC GCT CTT AAT AAC TCA ATC GGT GTT        697
Thr His Val Ala Gly Thr Ile Ala Ala Leu Asn Asn Ser Ile Gly Val
                70                  75                  80

CTG GGC GTT AGC CCA AGC GCA TCA TTA TAT GCA GTA AAA GTG CTT GAT        745
Leu Gly Val Ser Pro Ser Ala Ser Leu Tyr Ala Val Lys Val Leu Asp
            85                  90                  95

TCA ACA GGA AGC GGC CAA TAT AGC TGG ATT ATT AAC GGC ATT GAG TGG        793
Ser Thr Gly Ser Gly Gln Tyr Ser Trp Ile Ile Asn Gly Ile Glu Trp
        100                 105                 110

GCC ATT TCC AAC AAT ATG GAT GTT ATC AAC ATG AGC CTT GGC GGA CCT        841
Ala Ile Ser Asn Asn Met Asp Val Ile Asn Met Ser Leu Gly Gly Pro
    115                 120                 125

ACT GGT TCT ACA GCG CTG AAA ACA GTC GTT GAC AAA GCC GTT TCC AGC        889
Thr Gly Ser Thr Ala Leu Lys Thr Val Val Asp Lys Ala Val Ser Ser
130                 135                 140                 145

GGT ATC GTC GTT GCT GCC GCA GCC GGA AAC GAA GGT TCA TCC GGA AGC        937
Gly Ile Val Val Ala Ala Ala Ala Gly Asn Glu Gly Ser Ser Gly Ser
                150                 155                 160

ACA AGC ACA GTC GGC TAC CCT GCA AAA TAT CCT TCT ACT ATT GCA GTA        985
Thr Ser Thr Val Gly Tyr Pro Ala Lys Tyr Pro Ser Thr Ile Ala Val
            165                 170                 175

GGT GCG GTA AAC AGC AGC AAC CAA AGA GCT TCA TTC TCC AGC GCA GGT       1033
Gly Ala Val Asn Ser Ser Asn Gln Arg Ala Ser Phe Ser Ser Ala Gly
        180                 185                 190
```

-continued

```
TCT GAG CTT GAT GTG ATG GCT CCT GGC GTG TCC ATC CAA AGC ACA CTT      1081
Ser Glu Leu Asp Val Met Ala Pro Gly Val Ser Ile Gln Ser Thr Leu
    195                 200                 205

CCT GGA GGC ACT TAC GGC GCT TAT AAC GGA ACG TCC ATG GCG ACT CCT      1129
Pro Gly Gly Thr Tyr Gly Ala Tyr Asn Gly Thr Ser Met Ala Thr Pro
210                 215                 220                 225

CAC GTT GCC GGA GCA GCA GCG TTA ATT CTT TCT AAG CAC CCG ACT TGG      1177
His Val Ala Gly Ala Ala Ala Leu Ile Leu Ser Lys His Pro Thr Trp
                230                 235                 240

ACA AAC GCG CAA GTC CGT GAT CGT TTA GAA AGC ACT GCA ACA TAT CTT      1225
Thr Asn Ala Gln Val Arg Asp Arg Leu Glu Ser Thr Ala Thr Tyr Leu
            245                 250                 255

GGA AAC TCT TTC TAC TAT GGA AAA GGG TTA ATC AAC GTA CAA GCA GCT      1273
Gly Asn Ser Phe Tyr Tyr Gly Lys Gly Leu Ile Asn Val Gln Ala Ala
        260                 265                 270

GCA CAA TAA TAGTAAAAAG AAGCAGGTTC CTCCATACCT GCTTCTTTTT              1322
Ala Gln  *
    275

ATTTGTCAGC ATCCTGATGT TCCGGCGCAT TCTCTTCTTT CTCCGCATGT TGAATCCGTT    1382

CCATGATCGA CGGATGGCTG CCTCTGAAAA TCTTCACAAG CACCGGAGGA TCAACCTGCT    1442

CAGCCCCGTC ACGGCCAAAT CCTGAAACGT TTTAACACTG GCTTCTCTGT TCTCTGTC      1500
```

( 2 ) INFORMATION FOR SEQ ID NO:2:

( i ) SEQUENCE CHARACTERISTICS:
( A ) LENGTH: 381 amino acids
( B ) TYPE: amino acid
( D ) TOPOLOGY: linear ( i i ) MOLECULE TYPE: protein ( x i ) SEQUENCE DESCRIPTION: SEQ ID NO:2:

```
Val Arg Ser Lys Lys Leu Trp Ile Ser Leu Leu Phe Ala Leu Thr Leu
-106 -105                   -100                    -95

Ile Phe Thr Met Ala Phe Ser Asn Met Ser Ala Gln Ala Ala Gly Lys
-90                 -85                     -80                 -75

Ser Ser Thr Glu Lys Lys Tyr Ile Val Gly Phe Lys Gln Thr Met Ser
                -70                     -65                 -60

Ala Met Ser Ser Ala Lys Lys Lys Asp Val Ile Ser Glu Lys Gly Gly
            -55                     -50                 -45

Lys Val Gln Lys Gln Phe Lys Tyr Val Asn Ala Ala Ala Ala Thr Leu
        -40                     -35                 -30

Asp Glu Lys Ala Val Lys Glu Leu Lys Lys Asp Pro Ser Val Ala Tyr
    -25                 -20                 -15

Val Glu Glu Asp His Ile Ala His Glu Tyr Ala Gln Ser Val Pro Tyr
-10                 -5                  1                   5

Gly Ile Ser Gln Ile Lys Ala Pro Ala Leu His Ser Gln Gly Tyr Thr
            10                  15                  20

Gly Ser Asn Val Lys Val Ala Val Ile Asp Ser Gly Ile Asp Ser Ser
        25                  30                  35

His Pro Asp Leu Asn Val Arg Gly Gly Ala Ser Phe Val Pro Ser Glu
    40                  45                  50

Thr Asn Pro Tyr Gln Asp Gly Ser Ser His Gly Thr His Val Ala Gly
55                  60                  65                  70

Thr Ile Ala Ala Leu Asn Asn Ser Ile Gly Val Leu Gly Val Ser Pro
                75                  80                  85

Ser Ala Ser Leu Tyr Ala Val Lys Val Leu Asp Ser Thr Gly Ser Gly
            90                  95                  100
```

-continued

| | | | | | | | | | | | | | | | |
|---|---|---|---|---|---|---|---|---|---|---|---|---|---|---|---|
| Gln | Tyr | Ser | Trp | Ile | Ile | Asn | Gly | Ile | Glu | Trp | Ala | Ile | Ser | Asn | Asn |
| | | 105 | | | | | 110 | | | | | 115 | | | |
| Met | Asp | Val | Ile | Asn | Met | Ser | Leu | Gly | Gly | Pro | Thr | Gly | Ser | Thr | Ala |
| | 120 | | | | | 125 | | | | | 130 | | | | |
| Leu | Lys | Thr | Val | Val | Asp | Lys | Ala | Val | Ser | Ser | Gly | Ile | Val | Val | Ala |
| 135 | | | | | 140 | | | | | 145 | | | | | 150 |
| Ala | Ala | Ala | Gly | Asn | Glu | Gly | Ser | Ser | Gly | Ser | Thr | Ser | Thr | Val | Gly |
| | | | | 155 | | | | | 160 | | | | | 165 | |
| Tyr | Pro | Ala | Lys | Tyr | Pro | Ser | Thr | Ile | Ala | Val | Gly | Ala | Val | Asn | Ser |
| | | | 170 | | | | | 175 | | | | | 180 | | |
| Ser | Asn | Gln | Arg | Ala | Ser | Phe | Ser | Ser | Ala | Gly | Ser | Glu | Leu | Asp | Val |
| | | 185 | | | | | 190 | | | | | 195 | | | |
| Met | Ala | Pro | Gly | Val | Ser | Ile | Gln | Ser | Thr | Leu | Pro | Gly | Gly | Thr | Tyr |
| | 200 | | | | | 205 | | | | | 210 | | | | |
| Gly | Ala | Tyr | Asn | Gly | Thr | Ser | Met | Ala | Thr | Pro | His | Val | Ala | Gly | Ala |
| 215 | | | | | 220 | | | | | 225 | | | | | 230 |
| Ala | Ala | Leu | Ile | Leu | Ser | Lys | His | Pro | Thr | Trp | Thr | Asn | Ala | Gln | Val |
| | | | | 235 | | | | | 240 | | | | | 245 | |
| Arg | Asp | Arg | Leu | Glu | Ser | Thr | Ala | Thr | Tyr | Leu | Gly | Asn | Ser | Phe | Tyr |
| | | | 250 | | | | | 255 | | | | | 260 | | |
| Tyr | Gly | Lys | Gly | Leu | Ile | Asn | Val | Gln | Ala | Ala | Ala | Gln | | | |
| | | 265 | | | | | 270 | | | | | 275 | | | |

We claim:

1. A liquid detergent composition comprising from about 5% to about 60% by weight of an organic surface-active agent selected from nonionic, anionic, cationic and zwitterionic surface active agents and mixtures thereof, and an enzyme system comprising a lipase derived from *Humicola lanuginosa*, and a bacterial serine protease derived from bacillus subtilis selected from the group consisting of a bacillus subtilis which has been modified by replacing the methionine at position 197 in its amino acid sequence with cysteine or a bacillus subtilis which has been modified by replacing the methionine at position 216 in its amino acid sequence with cysteine wherein said lipase is present in an amount sufficient to provide from 0.1 to 10.000 Lipolytic Units per gram and wherein said protease is present in the amount of from 0.005 to 10 mg of active protease per gram of finished product, and from 0.01% to 5% by weight of the composition of an enzyme stabilization system selected from the group consisting of boric acid, 1,2-propane diol, carboxylic acids, and mixtures thereof and and wherein said composition having a pH of from 7.0 to 8.5.

2. A detergent composition according to claim 1 which comprises a lipase in amounts so as to obtain from 10 to 2500 Lipolytic Units per gram of finished product.

3. A detergent composition according to claim 1 which comprises a protease according to claim 1 or mixtures thereof, in mounts such as to obtain from 0.01 to 5.0 mg of active protease per gram of finished product.

4. A detergent composition according to claim 1 which comprises an additional enzyme component selected from cellulases, amylases, and mixtures thereof.

5. A liquid detergent composition containing especially stable combinations of protease and lipase detergent enzymes, which composition comprises:

A) from 10% to 40% by weight of a surface-active agent selected from anionic surfactants, nonionic surfactants and combinations thereof;

B) from 4% to 12% by weight of a detergent builder;

C) from 10 to 2.500 Lipolytic Units per gram of composition of a lipase derived from *Humicola lanuginosa; and*

D) from 0.1 to 5.0 mg of active protease per gram of composition of a serine protease which is derived from *Bacillus subtilis* and which has been modified by replacing the serine at, or homologous to, position 226 in its amino acid sequence with cysteine;

said composition having a pH of from 2.0 to 8.5.

6. A liquid detergent composition according to claim 5 wherein:

A) the surface-active agent comprises a combination of both i) anionic surfactants comprising sulfonate or sulfate salts containing in their structure an alkyl radical from about 8 to 22 carbon atoms; and ii) nonionic surfactants selected from a) fatty alcohol ethoxylates having from 12 to 15 carbon atoms and from about 4 to 10 moles of ethylene oxide per mole; and b) polyhydroxy fatty acid amide surfactants of the formula

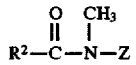

wherein $R^2$ is straight chain $C_{11-15}$ alkyl or alkenyl, and Z is derived from a reducing sugar selected from glucose, fructose, maltose, and lactose, in a reductive amination reaction; and c) combinations of these nonionic surfactants; and B) the detergent builder is selected from citric acid and succinic acid derivatives.

* * * * *